United States Patent [19]

Yoshida

[11] Patent Number: 4,688,611

[45] Date of Patent: Aug. 25, 1987

[54] CLEANING APPARATUS FOR FIXED VOLUME FILLING APPARATUS OF ROTARY TYPE

[75] Inventor: Shigeru Yoshida, Kanazawa, Japan

[73] Assignee: Shibuya Kogyo Co., Ltd., Kanazawa, Japan

[21] Appl. No.: 863,266

[22] Filed: May 14, 1986

[30] Foreign Application Priority Data

May 23, 1985 [JP] Japan ..... 60-111188
May 23, 1985 [JP] Japan ..... 60-111189

[51] Int. Cl.[4] ..... B65B 1/04

[52] U.S. Cl. ..... 141/91; 141/146; 222/146

[58] Field of Search ..... 222/148, 372, 149; 141/89, 90, 91, 146, 147, 148, 144

[56] References Cited

U.S. PATENT DOCUMENTS

| | | | |
|---|---|---|---|
| 3,207,189 | 9/1965 | Vergobbi | 222/148 |
| 3,874,825 | 4/1975 | Jentsch | 417/519 |
| 4,024,896 | 5/1977 | Ishioka et al. | 141/91 |
| 4,273,263 | 6/1981 | Voegele et al. | 222/148 |

FOREIGN PATENT DOCUMENTS

| | | | |
|---|---|---|---|
| 1434396 | 2/1965 | France | 141/146 |

*Primary Examiner*—H. Grant Skaggs
*Assistant Examiner*—Kenneth Noland
*Attorney, Agent, or Firm*—Flynn, Thiel, Boutell & Tanis

[57] ABSTRACT

A cleaning apparatus for a fixed volume, rotary filling apparatus. A rocking cam mechanism drives metering cylinder units. During cleaning, the rocking cam mechanism brings the individual pistons of several metering cylinder units to a common elevation, and a rotatable member lowers the corresponding cylinders so as to relatively slidably displace the pistons and the cylinders to a greater degree than during a normal filling operation, to enable seals (which normally seal the cylinder during the filling operation) to be separated from each other to define a cleaning passage therebetween. A valve mechanism selectively swtiches communication of the metering cylinder unit between a tank to be filled and the filling nozzle, during the normal filling operation, by changing paths formed in the sliding surfaces of a valve housing and a valve element by relative displacement therebetween. The valve housing and the valve element are relatively movable between a filling position, and a cleaning position. The sliding surfaces are separated from each other in such cleaning position to define a cleaning passage therebetween.

7 Claims, 9 Drawing Figures

CLEANING APPARATUS FOR FIXED VOLUME FILLING APPARATUS OF ROTARY TYPE

FIELD OF THE INVENTION

The invention relates to a fixed volume filling apparatus of rotary type, and more particularly, a cleaning apparatus which cleans such filling apparatus.

DESCRIPTION OF THE PRIOR ART

A variety of fixed volume filling apparatus of rotary type have already been proposed.

Usually, a fixed volume filling apparatus of rotary type comprises a rotating table which carries a plurality of elevating tables disposed around its outer periphery for transfer thereof by rotation, a rotatable member disposed above the rotating table for integral rotation therewith, a plurality of metering cylinder units, equal in number to the number of the elevating tables, mounted on the rotatable member and each including a cylinder and a piston with a seal disposed in the area of sliding contact therebetween to seal the interior of the cylinder, the piston being adapted to be driven for reciprocating movement to fill the cylinder with a given volume of liquid to be filled and to discharge it, a filling nozzle for a liquid to be filled which is discharged from each metering cylinder unit into a container which is supplied to the elevating table, a valve mechanism including a valve housing and a valve element which are disposed to be displaceable relative to each other and which have formed in their sliding surfaces, paths which selectively control a communication between a tank of liquid to be filled and the metering cylinder unit and a communication between the metering cylinder unit and the filling nozzle in accordance with the relative position between the valve housing and the valve element, and a cam mechanism operatively connected to each of the pistons to drive it for reciprocating movement.

A fixed volume filling apparatus of rotary type as described above is associated with a cleaning apparatus which cleans the apparatus. While a variety of cleaning apparatus are proposed, if a perfect cleaning is demanded, the metering cylinder unit and the valve mechanism are normally disassembled for cleaning purpose. Thus, considering a metering cylinder unit, a seal which seals the interior of the cylinder is disposed in the area of sliding contact between the cylinder and the piston, and hence the cylinder and the piston must be disassembled in order to completely clean the seal, thus requiring a troublesome operation.

A cleaning device for a cylinder unit which is provided with a single valve mechanism is disclosed in U.S. Pat. No. 4,273,263, for example. Specifically, the cylinder unit includes a cylinder and a piston, between which a seal is provided to seal the interior of the cylinder under a normal condition. However, when a cleaning operation is desired, the cylinder and the piston are moved to a defined cleaning position which is outside their normal range of movement so that a clearance or a cleaning path may be defined around the seal between the cylinder and the piston.

On the other hand, a valve mechanism includes a valve housing and a valve element which are movable relative to each other between a filling position and a cleaning position which are axially spaced from each other. When they are moved to the cleaning position, a cleaning path is defined between the sliding surfaces of the valve housing and the valve element, which switches the path.

With this construction, it is possible to define a cleaning path around the seal located between the cylinder and the piston and in the sliding surfaces of the valve housing and the valve element to facilitate a cleaning of these members without requiring their disassembly, by merely bringing the cylinder and the piston to the cleaning position which is outside the normal extent of reciprocating movement and bringing the valve housing and the valve element to the defined cleaning position.

However, when such a single cylinder unit is directly assembled into a rotary fixed volume filling apparatus of usual construction, the mechanical interlocking of each piston with an associated cam mechanism which causes a reciprocating movement thereof results in a piston in a metering cylinder unit which assumes a first position along the circumference to be located at its top end while a piston in another metering system to be located at its bottom end.

Accordingly, in order to enable a cleaning path through seals of every cylinder unit to be defined simultaneously, both the cylinders and the pistons must be brought to their given position which is outside its normal extent of reciprocating movement through an increased distance, resulting in an increased size of the cylinders and the pistons. This also accompanies an increased overall height of the filling apparatus, disadvantageously causing an increased size thereof.

As a modification of such approach, only part of the metering cylinder units may be selectively brought to their given position which is outside the normal extent of reciprocating movement in order to define a cleaning path around the seals. In such instance, the distance through which the cylinders and the pistons must be moved can be reduced, allowing a reduction in the size of the overall apparatus.

However, in this modification, all of the metering cylinder units can be cleaned only by operating the fixed volume filling apparatus in a manner such that the cleaning path can be defined successively for selected metering cylinder units. If a cleaning of all the metering cylinder units is all that is required, the rotary filling apparatus may be operated in a simple manner. However, if a cup-shaped cleaning instrument which corresponds to a container is placed on each of the elevating tables for recovery of a cleaning liquid so that the instrument may receive a cleaning liquid from the filling nozzle to enable the cleaning liquid to be recovered through the instrument, it would be necessary that a guide member which is normally provided to allow containers supplied onto the elevating tables to be carried externally be dismounted in order to avoid its interference with the cup-shaped cleaning instrument, again resulting in a troublesome cleaning operation.

It will be noted that a fixed volume filling apparatus of rotary type must be supplied with a liquid to be filled from a large size tank of liquid to be filled, which is disposed outside the apparatus, through a rotary joint, and the rotary joint must also be cleaned.

Normally, the rotary joint comprises a housing which is secured to an external frame in concentric relationship with the rotatable member, a rotating member disposed on the rotatable member for integral rotation therewith and disposed in sliding contact with the housing, and a fluid passage formed in both the housing and the rotating member so as to extend through sealed surfaces thereon where a sliding contact occurs therebetween. A sliding contact between the sealed surfaces allows the rotating member to rotate relative to the housing while permitting a flow of a liquid through the fluid passage.

A cleaning of the rotary joint normally takes place by simply passing a cleaning liquid through the fluid passage formed in the rotary joint. However, this results in an imperfect cleaning of the sealed surfaces on the housing and the rotating member, and if a more perfect cleaning operation is desired, the rotary joint must be disassembled, again requiring a troublesome operation.

SUMMARY OF THE INVENTION

In view of the foregoing, in accordance with the invention, a cam mechanism for a fixed volume filling apparatus of rotary type comprises a rocking cam mechanism including a rotary frame which is mechanically coupled to the pistons and arranged to rotate integrally with the rotating table, and a rocking frame which carries the rotary frame in a rotatable manner and which causes the rotary frame to tilt to a desired angle so that the stroke of the pistons may be changed in accordance with the tilting angle of the rotary frame. Also in accordance with the invention, the rotatable member is arranged to be freely elevatable on the rotating table so that its elevation can be adjusted to different levels during a filling operation and during a cleaning operation.

In the metering cylinder unit, a cylinder is mounted on the rotatable member, and when the rocking cam mechanism brings the individual pistons to a substantially aligned elevation and the rotatable member brings the individual cylinders to an elevation which is chosen for the cleaning operation, a cleaning passage is defined with the seals on the cylinders and the pistons separated from each other. In the valve mechanism, the valve housing and the valve element are disposed to be movable relative to each other between a filling position and a cleaning position which are axially spaced apart, and when they are in the cleaning position, the sliding surfaces are separated apart to define a cleaning passage therebetween.

With the described arrangement, the rocking cam mechanism is capable of bringing the individual pistons to a substantially aligned elevation, thus reducing the distance through which the cylinders and the pistons must be moved when defining a cleaning passage around the seals, thus enabling a reduction in the size of the overall apparatus. Since the cleaning passage is defined simultaneously for all of the metering cylinder units, there is no need to operate the filling apparatus in successive manner. Accordingly, if the cup-shaped cleaning instruments are used, there is no need to remove the guide member which is normally used to convey the containers externally, allowing a rapid cleaning operation.

In the rotary joint, either one of the housing and the rotating member is associated with its surrounding member while the other of the housing and the rotating member is fitted into the surrounding member in a rotatable manner and so as to be slidable in the axial direction so that when the rotatable member assumes an elevation for the filling operation, the rotating member is brought into contact with the housing to enable a flow of fluid through the fluid passage including the sealed surfaces while when the rotatable member assumes an elevation for the cleaning operation, the rotating member is spaced from the housing so that spaces defined between the sealed surfaces can be surrounded by the surrounding member.

With the described construction of the rotary joint, it is only necessary to supply a cleaning liquid into the fluid passage while maintaining the rotating member spaced from the housing to achieve a reliable cleaning of the sealed surfaces while preventing an external leakage of the cleaning liquid from the spaces defined between the sealed surfaces since such spaces are surrounded by the surrounding member.

Above and other objects, features and advantages of the invention will become apparent from the following description of embodiments thereof with reference to the drawings.

DETAILED DESCRIPTION OF EMBODIMENTS

Figure 1:
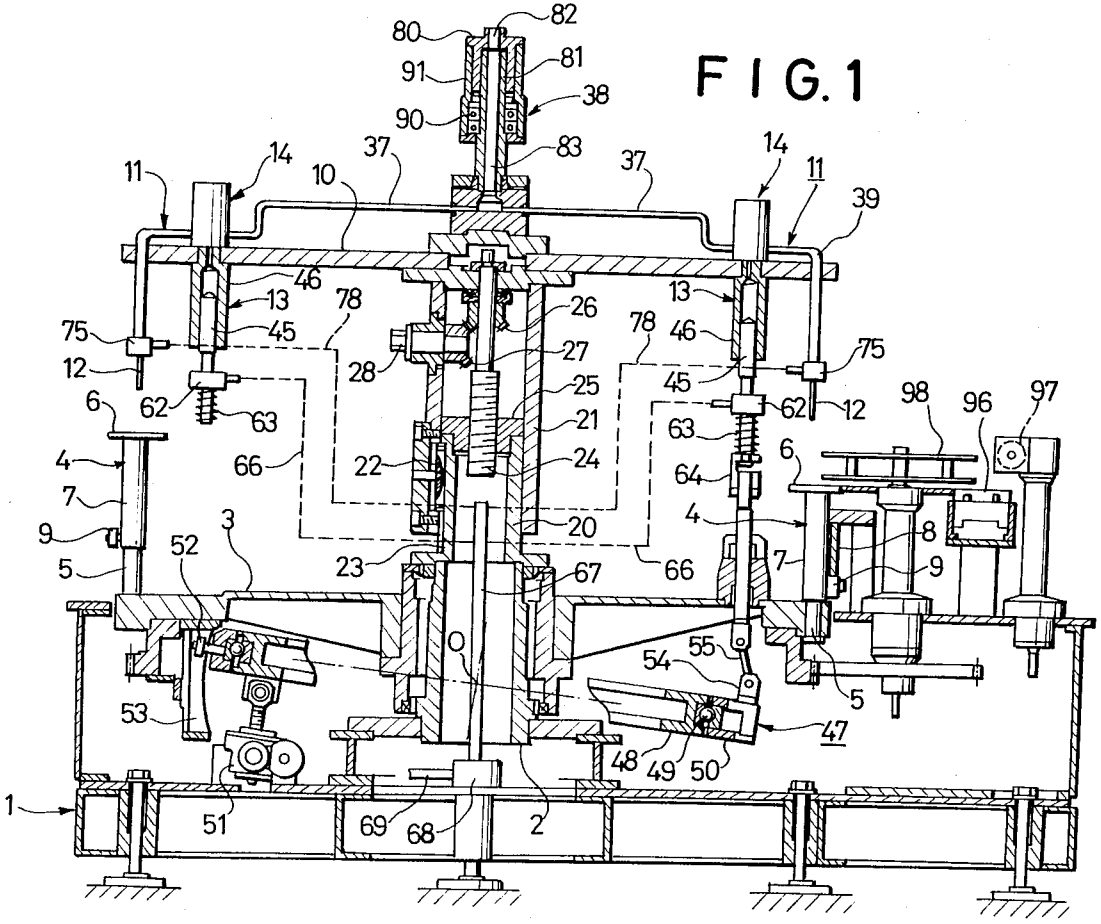
FIG. 1 is a section of one embodiment of the invention.

Referring to the drawings, a fixed volume filling apparatus of rotary type according to one embodiment of the invention will now be described. Initially referring to FIG. 1, there is shown a machine frame 1 on which is secured a vertical shaft 2 which rotatably carries a rotating table 3. A plurality of air cylinders 4 are disposed around the outer periphery of the rotating table 3 at an equal spacing. Each of the air cylinders 4 comprises a stationary member 5 secured to the table 3, and an elevating member 7 having an elevating table 6 mounted thereon on which a container is to be placed. The air cylinder 4 is normally energized to urge the elevating member 5 upward so that the elevating table 6 is maintained at its raised position. The air cylinder 4 may be replaced by a spring in order to urge the elevating table 6 upward.

It is to be noted that the air cylinders 4 are disposed in concentric relationship with the center of rotation of the rotating table 3, and a fixed cam 8 is fixedly mounted at selected positions along the locus of movement of the air cylinders on the outside thereof. The elevating member 7 is provided with a cam follower 9, which is adapted to engage the fixed cam 8 from its underside, whereby the elevating member 7 is caused to be lowered against the action of the air cylinder 4, in accordance with the cam profile of the fixed cam 8, thus allowing the elevation of container placed on the elevating table 6 to be controlled.

A rotatable member 10 is disposed above the rotating table 3 for integral rotation therewith. It will be seen that a filling nozzle 12, which defines a fixed volume filling mechanism 11, is mounted on the lower surface of the rotatable member around its outer periphery at a position which is directly above each elevating table 6. Each filling mechanism 11 comprises the filling nozzle 12 which injects a liquid to be filled into a container which is placed on the elevating table 6, a metering cylinder unit 13 which draws a liquid to be filled, as supplied from a tank of such liquid, not shown, so that such amount of liquid can be filled into the container through the filling nozzle 12, and a valve mechanism 14 which switches a flow path for the liquid to be filled which extends between the tank and the metering cylinder unit 13.

The rotatable member 10 is disposed so as to be elevatable between a raised position which is assumed during a normal filling operation and a bottom position which is assumed during a cleaning operation. Specifically, a sleeve-like member 20 is centrally mounted on the top surface of the rotating table 3 while a similar sleeve-like member 21 is mounted centrally on the lower surface of the rotatable member 10, and the both members are fitted together in a slidable manner. The sleeve-like member 21 is formed with a key 22 which is engaged with an axial keyway 23 formed in the peripheral surface of the sleeve-like member 20, thereby enabling the rotatable member 10 to the coupled to the rotating table 3 in an elevatable manner and for integral rotation.

A threaded shaft 24 is rotatably journalled in an axial portion of the sleeve-like member 21 and threadably engages with a nut member 25 which is secured to the top end of the sleeve-like member 20. The threaded shaft 24 has a gear 26 mounted thereon, which meshes with a gear 27 which is mounted on a drive shaft 28. The drive shaft 28 is coupled to a motor, not shown, which is disposed on the rotatable member 10, thus allowing the rotatable member 10 to be elevated relative to the rotating table 3.

Figure 2A:
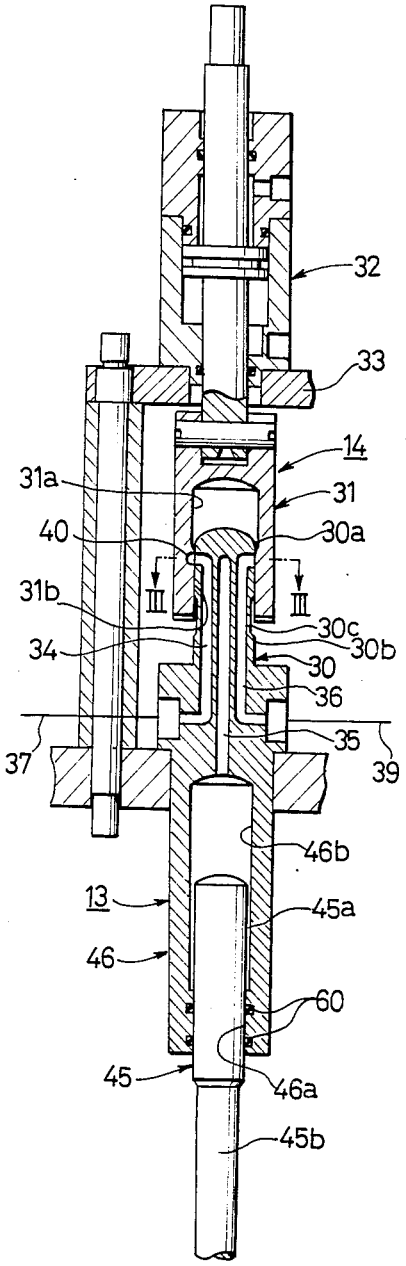
FIG. 2*a* is a section of a valve mechanism during a normal filling operation.

The detail of the valve mechanism 14 which forms part of the filling mechanism 11 is shown in an enlarged view of FIG. 2a. A solid cylindrical valve housing 30 is secured to the rotatable member 10 at a position directly above each elevating table 6 or directly above the metering cylinder unit 13, and a sleeve-like valve element 31 has a cylindrical lower end which is fitted around the top end of the valve housing 30 in an elevatable and a rotatable manner. The top end of the valve element 31 is mechanically coupled to an air cylinder 32 which causes an elevating motion thereof, and is also mechanically coupled drive means, not shown, which drives it for rotation. The air cylinder 32 is mounted on a bracket 33 extending from the rotatable member 10.

The peripheral surface of the valve housing 30 is divided into areas **30*a*, 30*b* of an increased diameter which are disposed toward the upper and lower ends thereof and an area 30*c* of a reduced diameter which is located between the area 30*a* and 30*b*. The valve housing 30 is formed with three axially extending passages 34, 35 and 36. Specifically, a first passage 34 has its bottom end disposed for communication with a tank of liquid to be filled, not shown, through a conduit 37 and a rotary joint 38 shown in FIG. 1. A second passage 35 has its bottom end disposed for communication with the metering cylinder unit 13. A third passage 36 has its bottom end disposed for communication with the filling nozzle 12 through a conduit 39**.

As shown in FIGS. **2*a* and 3, the top ends of the respective passages 34 to 36 open into the peripheral surface of the valve housing 30 in the area 30*a*. It is to be noted that the passage 35 which communicates with the metering cylinder unit 13 is located intermediate the remaining passage 34 and 36, which have their openings circumferentially displaced 90° from the central passage 35**.

Figure 3:
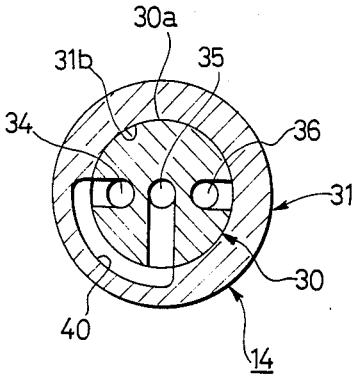
FIG. 3 is a cross section taken along the line III—III shown in FIG. 2*a;*

On the other hand, formed in the inner peripheral surface of the valve element 31 are a bore **31*a* of an increased diameter in an upper region and another bore 31*b* of a reduced diameter in a lower region. During a normal filling operation when the air cylinder 32 has driven the valve element 31 to its raised position, the bore 31*b* is brought into sliding contact with the uppermost area 30*a* of an increased diameter of the valve housing 30 where the respective passages 34 to 36 have their openings located. The inner peripheral surface of the lower bore 31*b* of a reduced diameter, which acts as a sliding surface, is formed with an annular groove 40 which extends circumferentially for substantially an arc of 90°, so that a communication between the adjacent passages 34 and 35 is established through the annular groove 40 at afirst rotational position of the valve element 31 and a communication between the passages 35 and 36 is established at a second rotational position which is 90° rotated from the first position, as indicated in FIG. 3**.

Consequently, when the valve element 31 is located at its first rotational position to provide a communication between the passages 34 and 35, a communication between the tank of liquid to be filled and the metering cylinder unit 13 is established. Accordingly, by driving a piston 45 of the metering cylinder unit 13 downward, a quantity of liquid to be filled can be withdrawn into the metering cylinder unit 13 from the tank. On the other hand, when the valve element 31 is located at its second rotational position to establish a communication between the passages 35 and 36 and hence a communication between the metering cylinder unit 13 and the filling nozzle 12, an upward movement of the piston 45 causes the liquid to be filled, which has been withdrawn in the metering cylinder unit 13, to be filled into a container through the filling nozzle 12.

During a cleaning operation when the air cylinder 32 drives the valve element 31 downward, the upper area **30*a* of an increased diameter of the valve housing 30 will be received within the upper bore 31*a* having an increased diameter of the valve element 31, whereby a communication among the passages 34 to 36 is allowed through clearances formed between the outer surface of the upper area 30*a* and the inner surface of the upper bore 31*a*. The outer surface of the upper area 30*a* and the inner surface of the lower bore 31*b*** which have been maintained in sliding contact with each other during the filling operation are separated from each other to provide a clearance therebetween, which is desired to establish a cleaning passage.

At the same time, the lower bore **31*b* of the valve element 31 is brought into sliding contact with the lower area 30*b* of an increased diameter of the valve housing 30, thus preventing any cleaning liquid from leaking externally through such region. If required, a small clearance may be defined between the lower bore 31*b* and the lower area 30*b*** of an increased diameter, so that a limited amount of cleaning liquid may leak through the clearance externally, thus allowing a satisfactory cleaning of associated parts.

It should be understood that the valve mechanism 14 is not limited to the construction mentioned above, but may be replaced by any other suitable arrangement, as disclosed in U.S. Pat. Nos. 4,273,263 and 3,874,825.

The metering cylinder unit 13 which forms part of the fixed volume filling mechanism 11 comprises a cylinder 46 which is formed integrally with the bottom portion of the valve housing 30, and a piston 45 which is slidably fitted into the cylinder 46 from the underside. As shown in FIG. 1, the piston 45 can be elevated by a rocking cam mechanism 47 which is disposed underside the rotating table 3.

The rocking cam mechanism 47 comprises a rocking frame 48 which is annular in configuration and is centered about the axis of the vertical shaft 2, and a rotary frame 50 which is disposed in surrounding relationship with the rocking frame and rotatable with respect thereto by means of ball bearings 49 interposed therebetween. The rocking frame 48 is rockable about an axis O which extends in a direction perpendicular to the plane of the drawing, as viewed in FIG. 1. A jack 51 is coupled to the rocking frame 48 so as to permit a rocking angle of the rocking frame as well as the rotary frame 50 to be adjusted.

The rotary frame 50 carried rollers at selected points around the periphery, and the rollers 52 engage cam grooves 53 which are formed in the lower surface of the rotating table 3 so as to be integral therewith. The respective cam grooves 53 are configured to follow the locus of movement of the rollers 52 as the rotary frame 50 is rocked through the rocking frame 48. Whenever the rotating table 3 is set in rotation, the rotary frame 50 is capable of rotating in an integral manner with the rotating table 3, irrespective of the tilting angle thereof, through the cam grooves 53 and the rollers 52.

A plurality of couplers 54, which are equal in number to the number of the fixed volume filling mechanisms 11, are mounted on the periphery of the rotary frame 50, with a connecting rod 55 connecting each coupler 54 with the piston 45 of the metering cylinder unit 13. Accordingly, as the rotating table 3 rotates together with the rotary frame 50, the piston 45 is elevated by an amount corresponding to the tilting angle of the rotary frame 50 through the action of the coupler 54 and the connecting rod 55. During the cleaning operation, the rotary frame 50 is repositioned to a horizontal position, whereby the elevation of the individual pistons 45 can be aligned with each other.

As shown in FIG. 2*a*, the piston 45 has an upper portion 45*a* of an increased diameter and a lower portion 45*b* of a reduced diameter. On the other hand, the cylinder 46 has a lower end which defines a bore 46*a* of a reduced diameter for sliding contact with the peripheral surface of the upper end 45*a* having an increased diameter of the piston while an upper portion of the cylinder defines a bore 46*b* of an increased diameter. During the normal filling operation, as the piston 45 is moved up and down, a sliding contact between the increased diameter portion 45*a* and the reduced diameter bore 46*a* is maintained so that such portions act as a seal. Seal members 60 are disposed in the inner surface of the bore 46*a* to maintain the liquid tightness of the internal space within the cylinder 46.

Figure 2B:
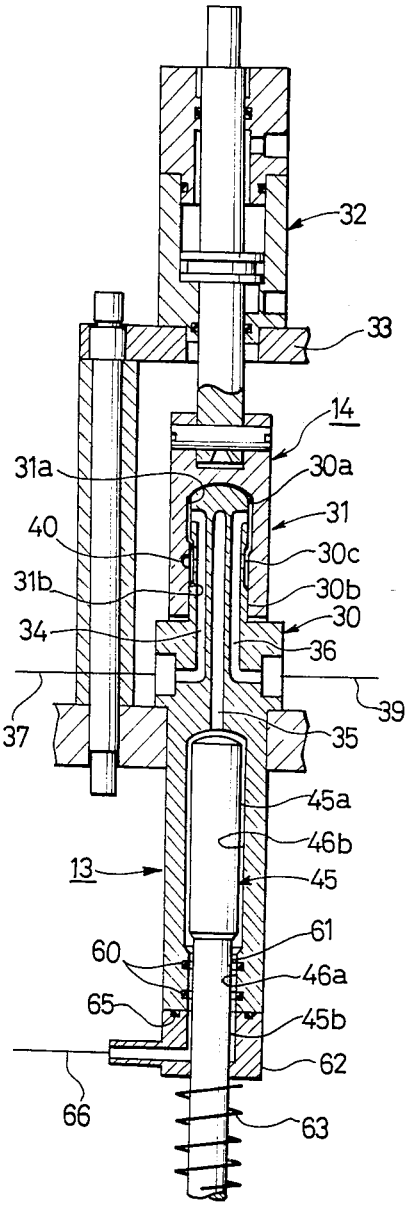
FIG. 2*b* is a section of the valve mechanism during a cleaning operation.

On the contrary, during the cleaning operation when the cylinder 46 is lowered by the action of the rotatable member 10, the increased diameter portion 45*a* of the piston 45 is caused to be fully inserted into the reduced diameter bore 46*b* of the cylinder 46 and the reduced diameter portion 45*b* of the piston 45 is located in the reduced diameter bore 46*a* of the cylinder 46, as shown in FIG. 2*b*, thus defining a cleaning passage 61 therebetween which allows a sufficient flow of a cleaning liquid through the region of the seal members 60.

A cup-shaped member 62 is mounted in an elevatable manner on the piston 45 at a location below the cylinder 46 so as to receive a cleaning liquid which flows through the region of the seal members 60. The cup-shaped member 62 is urged upward by a spring 63 which is disposed between the member 62 and a retainer 64 (FIG. 1) secured to the piston 45. The arrangement is such that during the normal filling operation, the cup-shaped member 62 which is positioned by the free length of the spring cannot abut against the cylinder 46 if the piston 45 assumes its upper position. On the other hand, during the cleaning operation when the cylinder 46 is lowered by the rotatable member 10, the cup-shaped member 62 is caused to abut against the lower end face of the cylinder 46 under pressure under the action of the spring 63 so that a seal member 65 disposed in the upper end face of the cup-shaped member 62 closes the cleaning passage 61. A conduit 66 is connected to the cup-shaped member 62, and communicates with a conduit 67 which is centrally disposed within the sleeve-like member 21 in the central region of the rotating table 3, and thence through a rotary joint 68 and a conduit 69 to a recovery vessel for the cleaning liquid, not shown.

Figure 4:
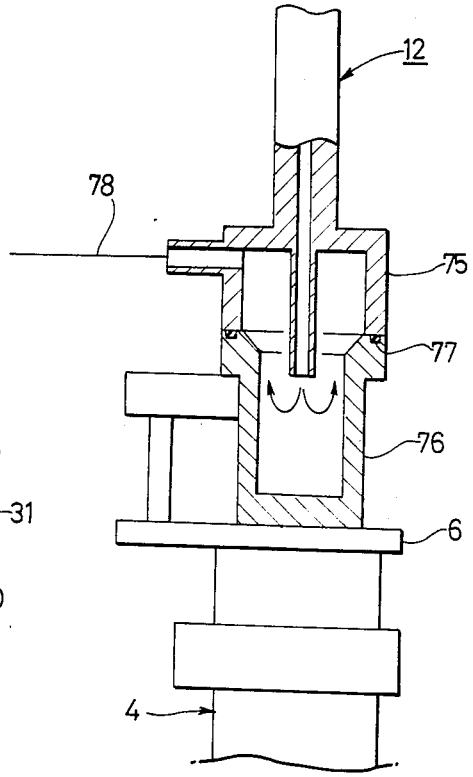
FIG. 4 is a section of a cup-shaped cleaning instrument which is mounted on a filling nozzle during a cleaning operation.

As shown in FIG. 4, adjacent to the lower end, the filling nozzle 12, which forms part of the fixed volume filling mechanism 11, is integrally provided with a member 75 in the form of an inverted cup which surrounds the lower end of the nozzle 12. The location of the inverted cup member 75 is chosen such that it cannot collide against a container as it is moved up and down on the elevating table 6 during the normal filling operation, but during the cleaning operation when the filling nozzle 12 is lowered together with the rotatable member 10, it abuts against the upper surface of a cup-shaped cleaning instrument 76 which is placed on the elevating table 6 to seal therebetween by means of a seal member 77 and to hold the instrument 76 down against the upward bias applied thereto from the air cylinder 4, thus allowing the individual instruments 76 to be aligned to an equal elevation.

Each of the inverted cup member 25 is connected to a conduit 78, which is in turn connected to the conduit 67 that is disposed within the sleeve-like member 21, thus allowing the internal space of the inverted cup member 75 and the cup-shaped cleaning instrument 76 to communicate with a recovery vessel for the cleaning liquid, not shown.

A rotary joint 38 which is disposed above the rotatable member 30 comprises a housing 80 which is secured to a machine frame, not shown, and having its lower portion integrally formed with a cylindrical surrounding member 79, and a rotatable member 81 which is mounted on the upper end of the rotatable member 10 in concentric relationship therewith and which is fitted into the surrounding member 79 in a rotatable and elevatable manner. A pair of axially aligned fluid passages 82, 83 are formed in the housing 80 and the rotatable member 81, respectively, and the fluid passage 82 formed in the housing 80 is in communication with the tank of liquid to be filled, not shown, while the fluid passage 83 formed in the rotatable member 81 is in communication with the path 37 connected to the valve mechanism 14.

Seal members 84, 85 are disposed around the openings of the respective fluid passages 82, 83 and are in sliding contact with each other so that the sliding contact between the both seal surfaces enable a rotation of the rotatable member 81 relative to the housing 80 while preventing a leakage of fluid from the clearance therebetween and allowing a flow of the fluid through the both passages 82, 83.

Figure 5A:
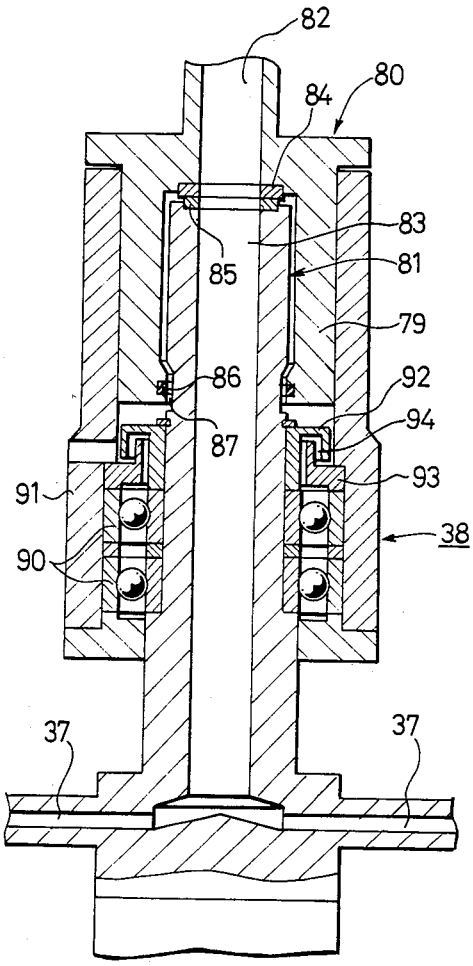
FIG. 5*a* is a cross section of a rotary joint during a normal filling operation.
Figure 5B:
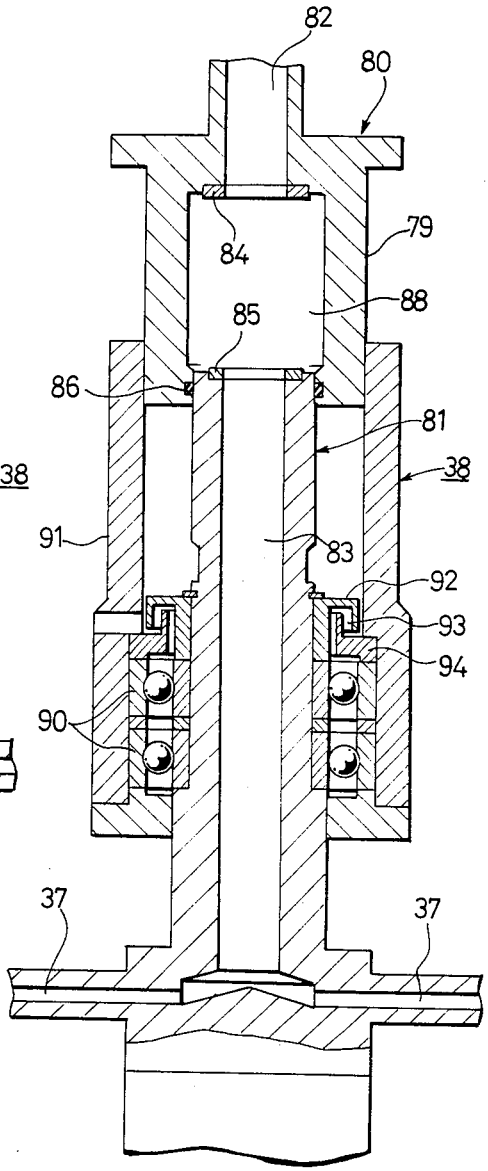
FIG. 5*b* is a cross section of the rotary joint during a cleaning operation.

In the lower portion, the inner peripheral surface of the cylindrical surrounding member 79 is formed with a reduced diameter portion 79*a* which is in sliding contact with the outer peripheral surface of the rotatable member 81 at its top end, and which is provided with a seal member 86. On the other hand, the outer peripheral surface of the rotatable member 81 is formed with a reduced diameter portion 81*a* at a location which will be opposite to the reduced diameter portion 79*a* during the normal filling condition when the seal members 84, 85 are in sliding contact with each other. This enables a passage 87 which allows any fluid leaking from between the seal members 84, 85 to flow therethrough, to be established between the inner peripheral surface of the surrounding member 79 and the outer peripheral surface of the rotating member 81 during a filling operation. On the other hand, during a cleaning operation when the rotatable member 81 is lowered in an integral manner with the rotatable member 10, the reduced diameter portion 79*a* of the surrounding member 79 is brought into sliding contact with the outer peripheral surface of the rotating member 81 at its top end, as indicated in FIG. 5*b*, to make the seal member 86 to be effective in providing a sealing action, thus disposing the surrounding member 79 in surrounding relationship with a space 88 formed between the both surfaces of the seal members 84, 85 when they are separated relative to each other, thereby preventing an external leakage of the cleaning liquid therefrom.

It is also to be noted that a cylindrical member 91 is rotatably mounted on the outside of the rotatable member 81 with a bearing 90 interposed therebetween so as to be fitted around the housing 80 to permit only its elevating motion. At a location above the bearing 90, the rotatable member 81 and the cylindrical member 91 are provided with labyrinth members 92, 93, respectively, so that the both members 92, 93 define a labyrinth 94 which prevents any liquid to be filled which may leak from the passage 87 during the normal filling operation from flowing to the underlying bearing 90.

In the fixed volume filling apparatus of rotary type as described above, both the rotatable member 10 and the valve member 31 are normally disposed at their raised positions during the filling operation while the rocking cam mechanism 47 has its rotary frame 50 disposed at a desired angle.

A container, not shown, is conveyed by a conveyor 96 shown in FIG. 1 and is synchronized with a feed star wheel by means of a timing screw 97. The star wheel then successively loads the containers onto each elevating table 6 one by one. When the container is loaded on the elevating table 6, it is raised as the elevating table 6 is raised by the cooperation between the air cylinder 4 and the fixed cam 8, and when the filling nozzle 12 enters the container as a result of such relative motion, the valve mechanism 14 is switched by drive means, not shown, to change the path of the liquid to be filled while at the same time the piston 45 in the metering cylinder unit 13 moves upward to initiate the filling of the liquid into the container.

When the piston 45 reaches the upper end of its stroke, the filling of the liquid into the container is completed, and at the same time, the valve mechanism 14 changes the path of the liquid to be filled, and the piston 45 of the metering cylinder 13 then moves downward, withdrawing a quantity of liquid to be filled into the cylinder 46. After being lowered to its original elevation, the filled container is delivered onto the conveyor 96 by means of a delivery star wheel, not shown.

When it is desired to clean the fixed volume filling apparatus, the jack 51 is operated to bring the rocking frame 48 and the rotary frame 50 of the rocking cam mechanism 47 to their substantially horizontal positions, thus causing the individual pistons 45 to assume an aligned elevation. The cup-shaped cleaning instrument 76 is placed on each of the elevating table 3. The rotatable member 10 is then allowed to move down, thus causing the inverted cup member 75 of the filling nozzle 12 to be disposed in abutment against the cleaning instrument 76 to allow the cleaning instrument 76 to be sealed by the seal member 76 and urging the individual cleaning instruments 76 against the action of the air cylinder 4 to achieve an aligned elevation of these instruments, as indicated in FIG. 4.

At the same time, the downward movement of the rotatable member 10 causes the cylinder 46 of the metering cylinder unit 13 to move down, thus defining the cleaning passage 61 in the region of the seal member 60 which seals between the piston 45 and the cylinder 46, as indicated in FIG. 2*b*. Under this condition, the cup-shaped member 62 is brought into abutment against the lower end face of the cylinder 46 under the resilience of the spring 63, thus closing the cleaning passage 61.

The downward movement of the rotatable member 10 also causes the rotatable member 81 of the rotary joint 38 to move down, thereby separating the seal members 84, 85 from each other, as indicated in FIG. 5*b*. The air cylinder 32 acts to move the valve member 31 downward, establishing a communication between the top ends of the respective passages 34 to 36 in the valve mechanism 14.

When a cleaning liquid, including a cleaning steam, is supplied from the passage 82 which is normally associated with the tank of liquid to be filled under this condition, the cleaning liquid initially cleans the both seal member 84, 85 in the rotary joint 38, flowing past thereover, and then finds its way into the passage 83 and the conduit 37 to be supplied to the interior of the valve member 31 through the passage 34 of the valve mechanism 14. When supplied to the interior of the valve member 31, the flow of the cleaning liquid is divided into two streams, one finding its way into the cylinder 46 through the passage 35 to clean the related part, and then flows through the cleaning passage 61 defined between the piston 45 and the cylinder 46, the interior of the cup-shaped member 62, and the conduit 66 to be introduced into the conduit 67, whereupon it is returned to a recovery vessel through the rotary joint 68 and the conduit 69.

On the other hand, the second stream is supplied through the passage 36 and the conduit 39 into the filling nozzle 12, and after cleaning the parts of the nozzle 12, it finds its way into the cup-shaped cleaning instrument 76 and thence through the conduits 78, 67 and the rotary joint 68 and the conduit 69 to be returned to the recovery vessel.

Figure 6A:
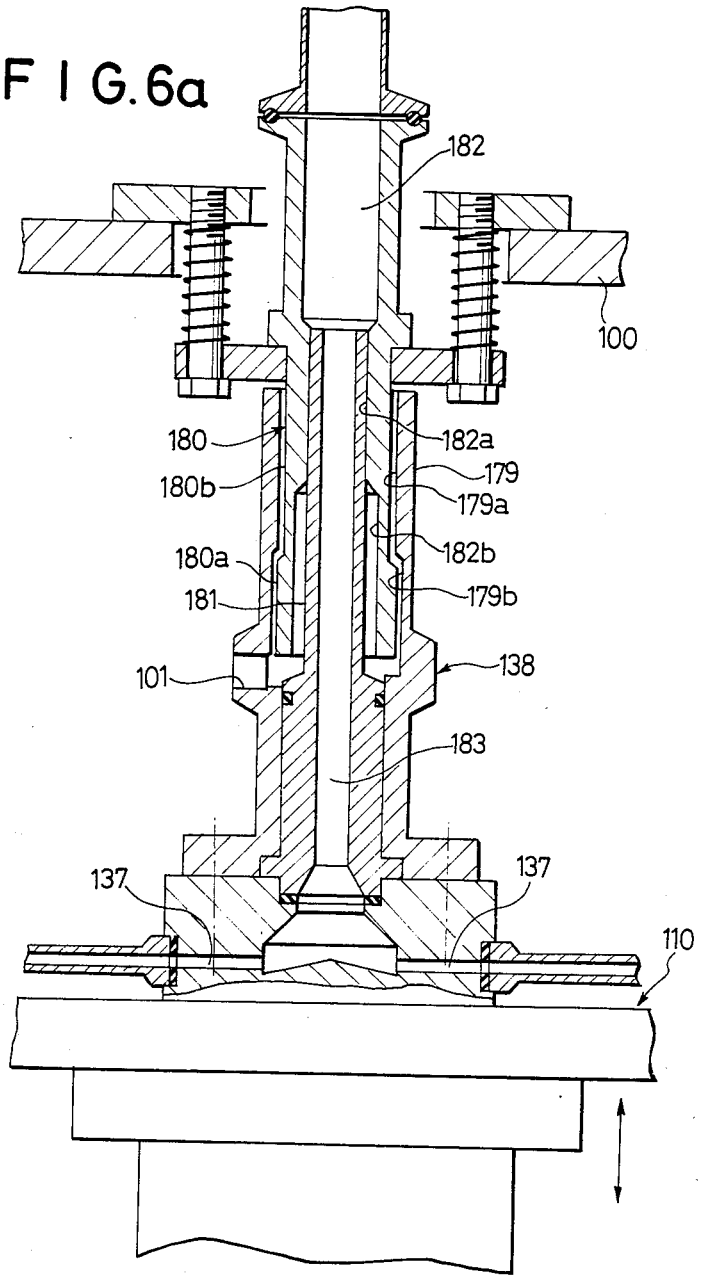
FIG. 6*a* is a cross section of another embodiment of the invention, illustrating a filling condition of another rotary joint.
Figure 6B:
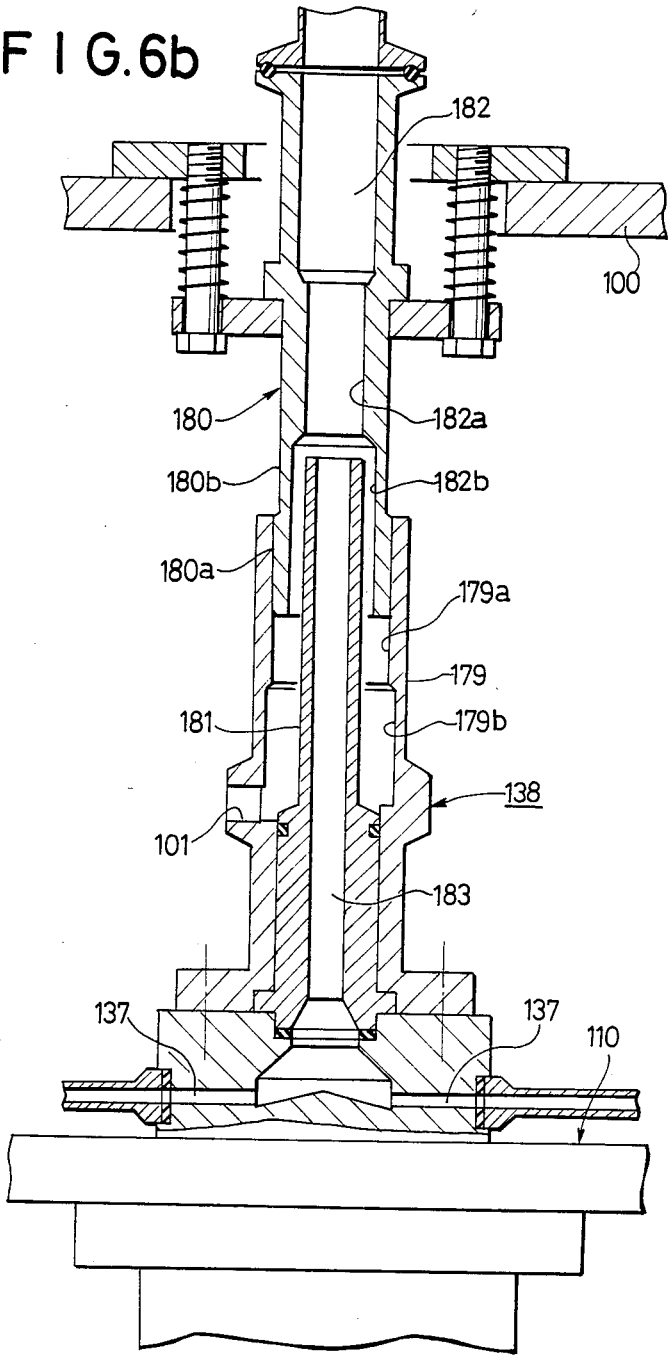
FIG. 6*b* is a cross section illustrating a cleaning condition of the rotary joint shown in FIG. 6*a.*

FIGS. 6*a* and 6*b* show another embodiment of the invention. These Figures illustrate a rotary joint 138 during the filling operation and during the cleaning operation, respectively. While in the described embodiment, the rotary joint 38 provides a seal against the liquid to be filled at a plane which is defined to be perpendicular to the axis of rotation by the seal members 84, 85 during the filling operation, in the present embodiment, a seal against the liquid to be filled is defined by a cylindrical surface which extends parallel to the axis of rotation.

Specifically, the rotary joint 138 comprises a support member 100 which is secured to a machine frame, not shown, a cylindrical housing 180 mounted in alignment with the axis of rotation of a rotatable member 110, and a cylindrical rotating member 181 which is mounted on the upper central end of the rotatable member 110. The rotating member 181 is fitted into the housing 180 in a rotatable and elevatable manner. It will be noted that a pair of aligned fluid passages 182, 183 are formed in the housing 180 and the rotating member 181, with the fluid passage 182 formed in the housing 180 being in communication with a tank of liquid to be filled, now shown, while the fluid passage 183 formed in the rotating member 181 is in communication with a passage 137 which is connected to a valve mechanism, not shown, in the similar manner as before.

The inner peripheral surface of the fluid passage 182 formed in the housing 180 is shaped into an upper portion 182*a* of a reduced diameter and a lower portion 182*b* of an increased diameter. On the other hand, the upper portion of the rotating member 181 which is fitted into this passage is of the same diameter as the diameter of the upper portion 182*a* of the fluid passage 182 so as to be tightly fitted therein. As shown in FIG. 6*a*, the rotating member 181 is fitted into the upper portion 182*a* having a reduced diameter of the fluid passage 182 during the normal filling operation, so that the sliding surfaces of the both members, which are cylindrical and concentric about the axis of rotation, provide a seal against the liquid to be filled.

By contrast, during the cleaning operation when the rotatable member 110 is lowered to locate the rotating member 181 within the lower portion 182*b* having an increased diameter of the fluid passage 182, the seal surfaces mentioned above are separate from each other to from a clearance between the outer peripheral surface of the rotating member 181 and the inner peripheral surface of the lower portion 182*b* having an increased diameter, thus allowing the both seal surfaces to be cleaned.

A cylindrical surrounding member 179 is mounted on the outside of the rotating member 181 so as to be concentric therewith, thus allowing the housing 180 to be fitted between the outer peripheral surface of the rotating member 181 and the inner peripheral surface of the surrounding member 179 in a rotatable and elevatable manner.

The inner peripheral surface of the surrounding member 179 is formed with an upper portion 179*a* of a reduced diameter and a lower portion 179*b* of an increased diameter. Similarly, the outer peripheral surface of the housing 180 is formed with an increased diameter portion 180*a* at its bottom which is adapted to be a close fit in the upper portion 179*a* of a reduced diameter and is also formed with a reduced diameter portion 180*b* toward its top end which is of a reduced size than the portion 180*a*.

With the rotary joint 138 described above, a close fitting between the inner peripheral surface of the upper portion 182*a* having a reduced diameter of the fluid passage 182 and the outer peripheral surface of the rotating member 181 provides effectively a seal against the liquid to be filled. At the same time, the lower portion 180*a* having a increased diameter of the housing 180 is loosely fitted into the lower portion 179*b* having an increased diameter of the surrounding member 179, and the upper portion 180*b* having a reduced diameter of the housing 180 is loosely fitted into the upper portion 179*a* having a reduced diameter of the surrounding member 179, thus preventing a sliding contact between the housing 180 and the surrounding member 179 so that they present no resistance to a sliding motion therebetween as a result of a sliding contact.

On the other hand, during the cleaning operation, a clearance is defined between the outer peripheral surface of the rotating member 181 and the inner peripheral surface of the lower portion 182*b*, having an increased diameter, of the fluid passage 182, thus providing a passage for the cleaning liquid. In addition, the lower portion 180*a* having an increased diameter of the housing 180 is closely fitted into the upper portion 179*a* having a reduced diameter of the surrounding member 179, preventing an external leakage of the cleaning liquid from the clearance between the housing 180 and the surrounding member 179. The cleaning liquid which has passed through the passage therefor is allowed to be returned to a recovery vessel through a passage 101 formed in the surrounding member 179 and an associated conduit, not shown.

While the invention has been specifically illustrated and described above in connection with several embodiments thereof, it should be understood that a number of changes, substitutions and modifications will readily occur to one skilled in the art without departing from the scope and spirit of the invention defined by the appended claims.

What is claimed is:

1. In a fixed volume filling apparatus of rotary type including a rotating table fixedly carrying a plurality of elevating tables disposed around its periphery for transfer thereof by rotation, a rotatable member disposed above the rotating table for integral rotation therewith, a plurality of metering cylinder units which are equal in number to the number of the elevating tables and mounted on the rotatable member, each of the metering cylinder units including a cylinder and a piston which is disposed therein for reciprocatory movement to withdraw or deliver a fixed quantity of liquid to be filled into or from the cylinder, each metering cylinder unit also including a seal disposed in an area of sliding contact between the cylinder and the piston to provide a seal for the cylinder, a filling nozzle associated with each metering cylinder unit to fill a liquid to be filled which is discharged from the associated metering cylinder unit into a container which is placed on the elevating table, a valve mechanism including a combination of a valve housing and a valve element which are disposed so as to be displaceable relative to each other, the valve housing and the valve element having respective sliding surfaces in which paths are formed which effectively change a communication between a tank of liquid to be filled and the metering cylinder unit and a communication between the metering cylinder unit and the filling nozzle in accordance with the relative position therebetween, and a cam mechanism mechanically linked to the respective piston for causing a reciprocating movement thereof;

a cleaning apparatus for the filling apparatus characterized in that the cam mechanism comprises a rocking cam mechanism comprising a rotary frame mechanically coupled to the piston and adapted to rotate integrally with the rotating table, and a rocking frame which supports the rotary frame in a rotatable manner and which causes the rotary frame to be tilted to a desired angle, the stroke of the piston being responsive to the tilt angle of the rotary frame, the rotatable member being disposed to be elevatable relative to the rotating table so that its elevation can be adjusted to different elevations during a filling operation and during a cleaning operation, the cylinder of the metering cylinder unit being mounted on the rotatable member so that the cylinder and the piston are separated from each other in the region of the seal to define a cleaning passage when the rocking cam mechanism has caused the individual pistons to be substantially aligned at a given elevation and the rotatable member has placed the cylinders at a lower elevation for the cleaning operation, the valve housing and the valve element of the valve mechanism being disposed to be movable relative to each other between a filling operation and a cleaning operation which are axially spaced from each other, the sliding surfaces of the valve housing and the valve element being separated from each other when the valve housing and the valve element are in their cleaning position, thereby defining a cleaning passage.

2. A cleaning apparatus for fixed volume filling apparatus of rotary type as defined in claim 1, further comprising a rotary joint including a housing secured to an external machine frame in concentric relationship with the center of rotation of the rotatable member, a rotating member disposed on the rotatable member for integral rotation therewith and in sliding contact with the housing, and a fluid passage formed to extend through seal surfaces of both the housing and the rotating member in the region where they are in sliding contact with each other, one of the housing and the rotating member being associated with a surrounding member while the other is fitted into the surrounding member in an axially slidable and rotatable manner so that when the rotatable member assumes an elevation for the filling operation, the housing and the rotating member are allowed to contact each other so that their seal surfaces permit a flow of a fluid through the fluid passage while allowing a rotation of the rotating member with respect to the housing, and when the rotatable member assumes a different elevation for the cleaning operation, the housing and the rotating member are separated from each other so that the surrounding member surrounds a space defined between the seal surfaces.

3. A cleaning apparatus for fixed volume filling apparatus of rotary type as defined in claim 1, further characterized in that the rotatable member and the rotating table each includes a cylindrical member which is fitted into the rotatable member of the rotating table in concentric relationship therewith and in an elevatable manner relative to each other while being integrally coupled rotationally, one of the cylindrical members being secured to a nut member which is threadably engaged by a threaded member pivotally mounted on the other cylindrical member, the threaded member being coupled to a motor.

4. A cleaning apparatus for fixed volume filling apparatus of rotary type as defined in claim 1, further characterized in that the piston of the metering cylinder unit includes an upper portion of an increased diameter and a lower portion of a reduced diameter which is contiguous with the upper portion while the cylinder is formed with a lower bore of a reduced diameter which is in sliding contact with the upper portion having an increased diameter of the piston to define the seal and an upper bore of an increased diameter which is contiguous therewith so that when the rotatable member has placed the cylinder at an elevation for the cleaning operation, the upper portion having an increased diameter of the piston is disposed within the upper bore having an increased diameter of the cylinder to define a cleaning passage therebetween while the lower portion having a reduced diameter of the piston is disposed within the lower bore having a reduced diameter of the cylinder to define a cleaning passage therebetween.

5. A cleaning apparatus for fixed volume filling apparatus of rotary type as defined in claim 4, further characterized in that a cup-shaped member is slidably fitted around the lower portion having a reduced diameter of the piston in a liquid tight manner, at a location below the cylinder, the cup-shaped member being urged upwardly so that when the cylinder is lowered to an elevation for the cleaning operation, the cup-shaped member is caused to bear closely against the lower end face of the cylinder to permit a cleaning passage formed between the lower portion having a reduced diameter of the piston and the lower bore having a reduced diameter of the cylinder to communicate with the interior of the cup-shaped member, the cup-shaped member being connected to a conduit which communicates with the cleaning passage through the cup-shaped member.

6. A cleaning apparatus for fixed volume filling apparatus of rotary type as defined in claim 1, further characterized in that the valve housing of the valve mechanism is formed by a solid cylindrical member and the valve element is formed by a hollow cylindrical member which is fitted around the solid cylindrical member so that during a normal filling operation, the outer peripheral surface of the solid cylindrical member in a region having an increased diameter is disposed in sliding contact with the inner peripheral surface of the hollow cylindrical member in a region having a reduced diameter, thereby enabling the paths to be switched by rotation of the hollow cylindrical member, while during a cleaning operation, the hollow cylindrical member is axially displaced to define a cleaning passage between the outer peripheral surface of the solid cylindrical member in the region having an increased diameter and the inner peripheral surface of the hollow cylindrical member in a region of an increased diameter bore while simultaneously defining a cleaning passage between the inner peripheral surface of the hollow cylindrical member in the region of a reduced diameter bore and the outer peripheral surface of the solid cylindrical member in a region having a reduced diameter.

7. A cleaning apparatus for fixed volume filling apparatus of rotary type as defined in claim 1, further characterized in that a cup-shaped member is placed on the elevating table during a cleaning operation so that when the rotatable member has placed the filling nozzle at an elevation for a cleaning operation, the cup-shaped member closely bears against an inverted cup-shaped member mounted on the filling nozzle to seal the filling nozzle, the inverted cup-shaped member being connected to a conduit which communicates with the filling nozzle.

* * * * *